US005996819A

United States Patent [19]

Klein

[11] Patent Number: 5,996,819

[45] Date of Patent: Dec. 7, 1999

[54] DISPLAY STAND FOR LAMP SHADES

[75] Inventor: Monroe Klein, Staten Island, N.Y.

[73] Assignee: Arthur J. Klein & Co. Inc., Staten Island, N.Y.

[21] Appl. No.: 09/067,392

[22] Filed: Apr. 28, 1998

Related U.S. Application Data

[60] Provisional application No. 60/058,348, Sep. 10, 1997.

[51] Int. Cl.[6] ..... A47F 7/00; B42F 7/00

[52] U.S. Cl. ..... 211/85.14; 211/49.1; 211/59.1

[58] Field of Search ..... 211/85.14, 59.1, 211/49.1, 163

[56] References Cited

U.S. PATENT DOCUMENTS

| | | | |
|---|---|---|---|
| D. 96,363 | 7/1935 | Arnold | 211/59.1 X |
| 410,175 | 9/1889 | McAlister | 211/59.1 X |
| 1,620,148 | 3/1927 | Williams | 211/59.1 |
| 2,890,801 | 6/1959 | Ladd et al. | 211/59.1 |
| 4,971,234 | 11/1990 | Hay | 211/131.1 X |
| 5,839,586 | 11/1998 | Smith | 211/59.1 X |

*Primary Examiner*—Daniel P. Stodola
*Assistant Examiner*—Erica B. Harris
*Attorney, Agent, or Firm*—Cummings & Lockwood

[57] ABSTRACT

A display stand is provided for lamp shades which includes an upstanding axial mast and a plurality of display members which are mounted on the mast in axially spaced apart relationship. Each of the display members includes a central hub portion mounted for rotation relative to the axial mast and a plurality of circumferentially spaced apart arms projecting radially outward from the central hub portion to define an outer diameter of each display member circumscribing the spaced apart arms. Each display member has the same outer diameter with respect to the axial mast and each arm has an upstanding post extending therefrom for supporting a plurality of nested lamp shades in a manner suitable for display.

17 Claims, 2 Drawing Sheets

DISPLAY STAND FOR LAMP SHADES

CROSS-REFERENCE TO RELATED APPLICATIONS

The subject application claims priority to U.S. Provisional Patent Application Ser. No. 60/058,348 which was filed on Sep. 10, 1997, now abandoned.

BACKGROUND OF THE INVENTION

1. Field of the Invention

The subject invention relates to a merchandise display stand, and more particularly, to a stand for displaying a plurality of nested lamp shades in a convenient and efficient manner.

2. Background of the Related Art

It has become commonplace for merchants of household goods to display lamp shades on linear shelves. This practice necessarily requires the use of a vast amount of valuable shelf space. In some instances, an entire aisle of a store may be devoted to the display of a wide assortment of lamp shades of various sizes, styles and colors. Lamp shades displayed in this manner often become displaced and unorganized, making the shelves appear rather unsightly.

It would be beneficial to merchants of household goods to provide an apparatus for displaying a plurality of lamp shades of various sizes, styles and colors in a manner which would conserve valuable shelf space and improve the aesthetic characteristics of a store.

SUMMARY OF THE INVENTION

The subject invention is directed to a display stand for presenting a plurality of nested lamp shades in a unique manner which facilitates the ready removal of a selected stack of nested lamp shades from the display stand. In accordance with a preferred embodiment of the subject invention, the display stand includes an upstanding axial mast and a plurality of display members which are mounted on the mast in axially spaced apart relationship. Each of the display members includes a central hub portion mounted for rotation relative to the axial mast and a plurality of circumferentially spaced apart arms projecting radially outward from the central hub portion. Each arm has an upstanding post extending therefrom for supporting a plurality of nested lamp shades in a manner suitable for display.

Preferably, the display stand of the subject invention includes a base portion for supporting the upstanding axial mast on a surface. It is envisioned that other means may be provided for supporting the upstanding mast of the display stand on a particular surface, such as, for example, fasteners or clips. Alternatively, a tripod-like structure may be employed to support the upstanding mast on a particular surface.

In accordance with a preferred embodiment of the subject invention, the upstanding post on each arm of each display member is disposed intermediate the hub portion of the display member and a radially outer end of that arm. Thus, when a plurality of nested lamp shades are positioned on each upstanding post, the display stand will be well balanced.

In operation, each display member is independently rotatable to facilitate the movement of a selected stack of nested lamp shades to a position in which the selected stack of nested lamp shades is out of axial alignment with adjacent stacks of nested lamp shades, thereby facilitating the ready removal of the selected stack of nested lamp shades from the display stand.

These and other unique features of the display stand of the subject invention will become more readily apparent from the following description of the drawings.

BRIEF DESCRIPTION OF THE DRAWINGS

So that those having ordinary skill in the art to which the subject invention appertains will more readily understand how to construct and use the lamp shade display stand of the subject invention, reference may be had to the drawings wherein.

These and other features of the lamp shade display stand of the subject invention will become more readily apparent to those having ordinary skill in the art from the following detailed description of the invention taken in conjunction with the drawings.

DETAILED DESCRIPTION OF THE PREFERRED EMBODIMENTS

Figure 1:
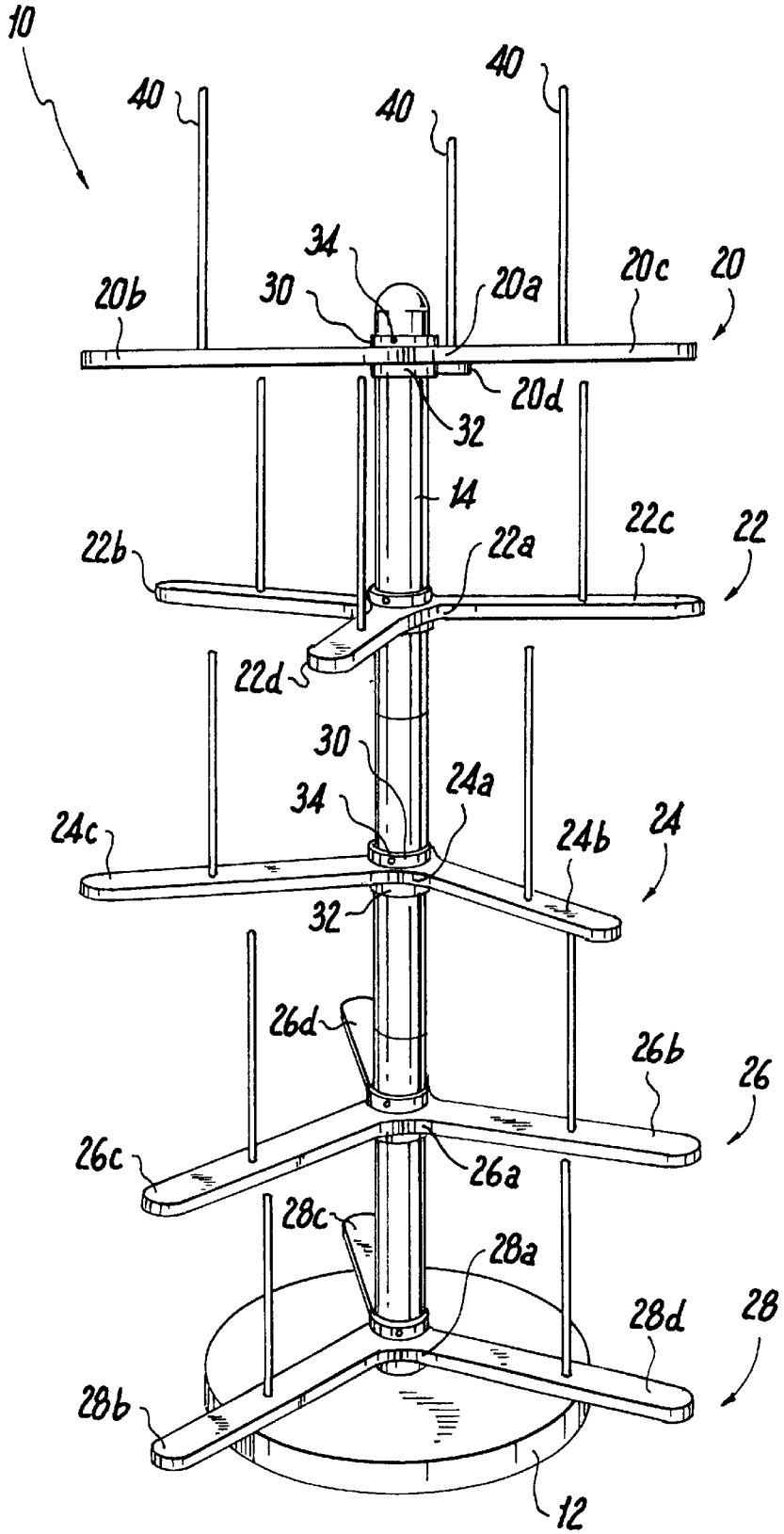
FIG. 1 is a perspective view of a display stand constructed in accordance with a preferred embodiment of the subject invention.

Referring now to the drawings wherein like reference numerals identify similar structural elements, there is illustrated in FIG. 1 a lamp shade display apparatus constructed in accordance with a preferred embodiment of the subject invention and designated generally by reference numeral 10. The structural components of display apparatus 10 are preferably formed from a lightweight plastic, such as, for example, polyvinyl chloride (PVC). However, it is envisioned that the many of the components of display apparatus 10 may be formed from a lightweight metal, such as, for example, stainless steel or aluminum. Alternatively, various components of display apparatus 10 may be constructed from a decorative wood.

Referring to FIG. 1, display apparatus 10 includes a circular base 12 for supporting the display apparatus upon a particular surface. Other structures may be employed to form the base of the apparatus such as, for example, a tripod arrangement. An upstanding mast 14 extends from base portion 12 to define the central axis of display apparatus 10. The mast 14 is preferably constructed from a plurality of tubular members which are fit together during assembly. Alternatively, mast 14 may be of monolithic construction.

With continuing reference to FIG. 1, display apparatus 10 further includes five axially spaced apart display members which are mounted for rotation about the upstanding mast 14, and which are designated generally by reference numerals 20, 22, 24, 26 and 28, respectively. Each of the five display members incudes a central hub portion 20*a*, 22*a*, 24*a*, 26*a* and 28*a*, respectively, which is rotatably supported on the upstanding mast 14 by upper and lower support collars 30 and 32. The support collars are secured to the upstanding mast by conventional fasteners 34, such as, for example, threaded fasteners.

Three circumferentially spaced apart elongated arms extend radially outward from the central hub of each of the five display members. By way of example, the uppermost display member 20 includes elongated arms 20*b*, 20*c* and 20*d* which extend radially outward from central hub portion 20*a*. The outwardly extending arms of display members 22, 24, 26 and 28 are identified by similar reference numerals in FIG. 1. Preferably, the hub portion and the three elongated arms of each display member are monolithically formed. However, it is envisioned that each of the display members may be assembled from a plurality of separate structural components.

Figure 2:
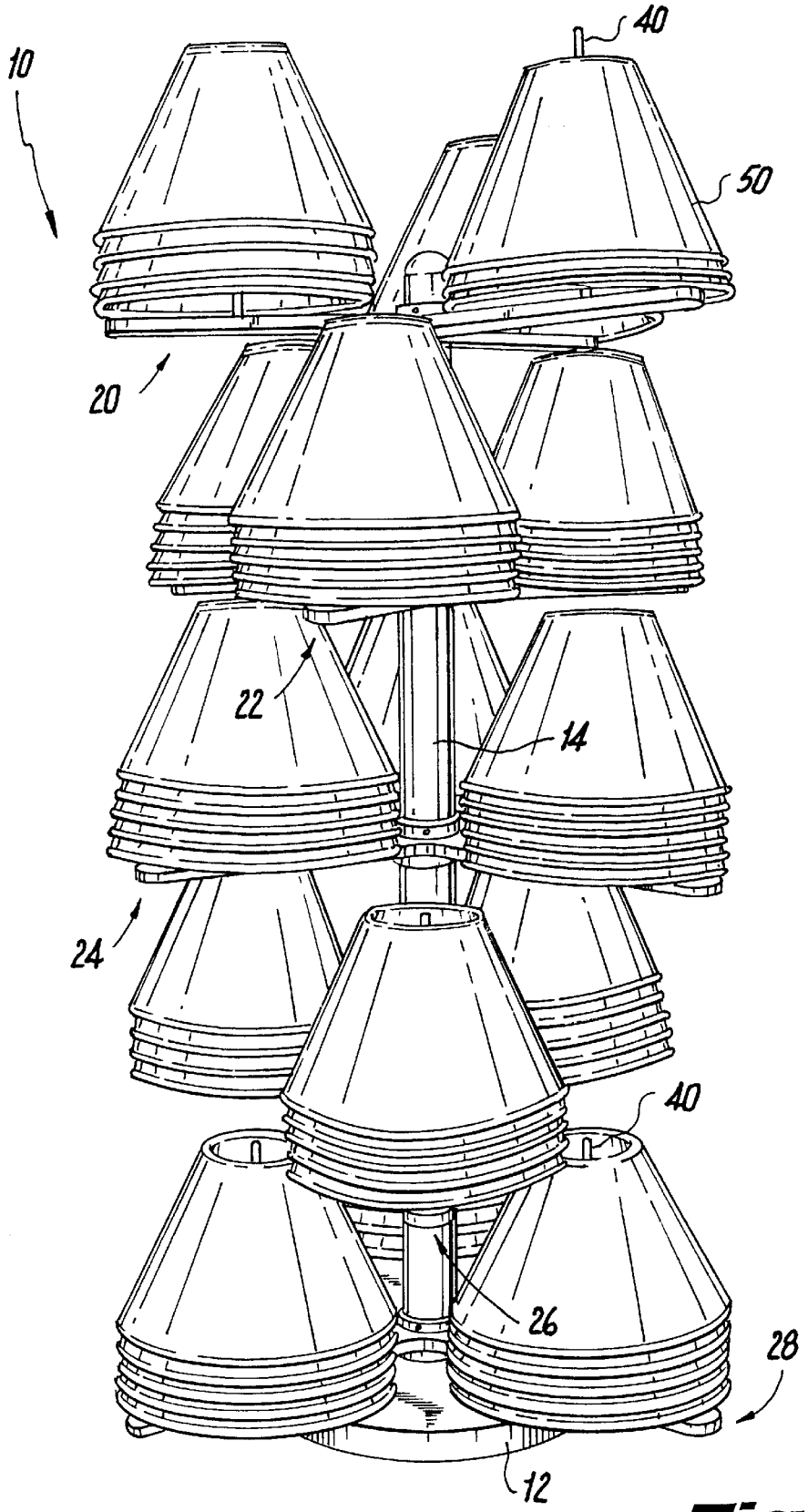
FIG. 2 is a perspective view of the display stand of FIG. 1 with a plurality of nested sets of lamp shades displayed thereon.

Upstanding posts 40 extend from each of the three elongated arms of display members 20–28 for supporting a plurality of stacks of nested lamp shades, as illustrated in FIG. 2. The upstanding post 40 on each elongated arm is disposed intermediate the hub portion and the radially outer end of the arm. Thus, the load supported by each arm will be centrally located, lending to the stability of display apparatus 10.

Referring now to FIG. 2, in operation, when a stack of nested lamp shades 50 is displayed on each upstanding post 40, each of the five display members of apparatus 10 are independently rotatable about the upstanding mast 14 to facilitate the movement of a selected stack of nested lamp shades to a position in which the selected stack is out of axial alignment with adjacent stacks of nested lamp shades, thereby facilitating the ready removal of the selected stack from display apparatus 10 without disrupting other unselected lamp shades. Thus, the lamp shades which remain on the display apparatus are maintained in an aesthetically pleasing manner.

Although, display apparatus 10 is illustrated and described as having five axially spaced apart rotatable display members, those skilled in the art will readily appreciate that any number of display members may be rotatably mounted on the upstanding mast. Thus the height of the display apparatus may vary. It will also be readily apparent to those skilled in the art that the display apparatus of the subject invention can be constructed not only as a floor mounted display, but it can also be constructed to fit upon a counter top. In such an instance, the number of rotatable display members may be as few as two.

Although the subject invention has been described with respect to a preferred embodiment, it is apparent that modifications and changes can be made thereto without departing from the spirit and scope of the invention as defined by the claims.

What is claimed is:

1. A display stand for lamp shades comprising:

a) an upstanding axial mast; and b) a plurality of display members mounted on said mast in axially spaced apart relationship, each of said display members including a central hub portion mounted for rotation relative to said axial mast and a plurality of circumferentially spaced apart arms projecting radially outward from said central hub portion to define an outer diameter of each display member circumscribing said spaced apart arms, each arm having an upstanding post extending therefrom, disposed centrally between said hub portion and a radially outer end of said arm, for supporting a plurality of nested lamp shades in a manner suitable for display, each of said plurality of display members having the same outer diameter with respect to said axial mast, wherein each of said display members has an equal number of spaced apart arms.

2. A display stand as recited in claim 1, further comprising a base portion for supporting said upstanding axial mast on a surface.

3. A display stand as recited in claim 1, further comprising means for supporting said upstanding axial mast on a surface.

4. A display stand as recited in claim 1, wherein said plurality of display members includes at least two axially spaced apart display members.

5. A display stand as recited in claim 1, wherein each display member includes at least three radially projecting arms.

6. A display stand as recited in claim 1, wherein each display member is of monolithic construction.

7. A display stand as recited in claim 1, further comprising means for rotatably supporting each display member on said axial mast.

8. A display stand for lamp shades comprising:

a) a base portion;

b) an upstanding axial mast extending from said base portion; and c) a plurality of display members mounted on said mast in axially spaced apart relationship, each of said display members including:

i) a central hub portion mounted for axial rotation about said axial mast;

ii) an equal number of circumferentially spaced apart arms projecting radially outward from said central hub portion to define an outer diameter of said display member circumscribing said space apart arms; and iii) an upstanding post extending from each of said plurality of arms, disposed centrally between said central hub portion and a radially outer end of each of said arms, for supporting a plurality of nested lamp shades in a manner suitable for display, each of said display members having the same outer diameter with respect to said axial mast.

9. A display stand as recited in claim 8, wherein said plurality of display members includes at least two axially spaced apart display members.

10. A display stand as recited in claim 8, wherein each display member includes at least three radially projecting arms.

11. A display stand as recited in claim 8, wherein each display member is of monolithic construction.

12. A display stand as recited in claim 8, wherein support collars are associated with the hub portion of each display member to rotatably support each display member on said axial mast.

13. A display stand for lamp shades comprising:

a) a base portion;

b) an upstanding axial mast extending from said base portion; and c) at least two display members mounted on said mast in axially spaced apart relationship, each of said at least two display members including:

i) a central hub portion mounted for axial rotation about said axial mast;

ii) three circumferentially spaced apart arms projecting radially outward from said central hub portion, each of said circumferentially spaced apart arms having an equal length such that said at least two display members have equal outer diameters with respect to said axial mast; and iii) an upstanding post extending from each of said arms, disposed centrally between said hub portion and a radially outer end of each of said arms, for supporting a plurality of nested lamp shades in a manner suitable for display.

14. A display stand as recited in claim 13, wherein five axially spaced apart display members are rotatably supported on said axial mast.

15. A display stand as recited in claim 13, wherein each of said at least two display members is of monolithic construction.

16. A display stand as recited in claim 15, further comprising means for rotatably supporting each of said at least two display members on said axial mast.

17. A display stand as recited in claim 16, wherein said supporting means comprises upper and lower support collars associated with the hub portion of each of said at least two display members.

* * * * *